US005309949A

United States Patent [19]

Tremer

[11] Patent Number: 5,309,949

[45] Date of Patent: May 10, 1994

[54] KNIFE CONTROL MECHANISM FOR A WEAVING LOOM

[75] Inventor: Siegmund H. Tremer, Eckersdorf, Fed. Rep. of Germany

[73] Assignee: Staubli-Trumpelt GmbH Maschinenfabrik, Bayreuth, France

[21] Appl. No.: 37,444

[22] Filed: Mar. 26, 1993

[30] Foreign Application Priority Data

Apr. 14, 1992 [FR] France ..... 92 04880

[51] Int. Cl.[5] ..... D03C 1/18; D03C 1/26

[52] U.S. Cl. ..... 139/79; 139/66 R

[58] Field of Search ..... 139/79, 66 R, 71, 69, 139/76, 66 A, 72, 67

[56] References Cited

U.S. PATENT DOCUMENTS 3,378,038 4/1968 Hadinec ..... 139/72

4,984,607 1/1991 Beyaert ..... 139/79

FOREIGN PATENT DOCUMENTS 592892 10/1947 United Kingdom ..... 139/67

1032014 6/1966 United Kingdom ..... 139/67

*Primary Examiner*—Andrew M. Falik

*Attorney, Agent, or Firm*—Dowell & Dowell

[57] ABSTRACT

A mechanism for controlling the reciprocating movement of knives associated with rocking hooks connected to the heddle frames of a weaving machine which mechanism includes a pair of rotatable drums oriented parallel to the path of movement of the knives. Each drum includes two profiled grooves in the surface thereof in which tracking members associated with the knives are cooperatively guided.

8 Claims, 2 Drawing Sheets

KNIFE CONTROL MECHANISM FOR A WEAVING LOOM

BACKGROUND OF THE INVENTION

1. Field of the Invention

The present invention relates to heavy dobbies used for forming the shed in weaving machines of very large width, of the type particularly employed for manufacturing tubular fabrics adapted for the production of endless dry felts or filters for the paper-making industry.

2. History of Related Art

Due to the very considerable amplitude of the stroke of the heddle frames associated with these dobbies, the conventional open-shed systems cannot be used and closed-shed dobbies must be employed in which each frame moves downwardly or upwardly from a mean position corresponding to the point of crossing of the assembly of the frames.

FIG. 1 of the accompanying drawings schematically shows the general arrangement of the heavy closed-shed dobbies of conventional type. Each of the heddle frames CL mounted on the weaving machine is connected by a system of rods 1 to a corresponding oscillating lever 2, articulated at 2*a* on a fixed frame. Opposite pivot point 2*a*. each lever 2, provided with a stop 2*b*. supports a double rocking hook 3 which is pivotally controlled by pushers of a reading mechanism of the dobby in order to come selectively into engagement with one or the other of two actuation knives 4, which, suitably guided horizontally, are controlled in order to simultaneously move reciprocally in opposite directions.

Actuation of the assembly of the double hooks 3 by the reading mechanism is effected when the two knives 4 lie in a central position in which the levers 2 are oriented vertically. It will be understood that, depending on whether a hook cooperates with one or the other of the knives 4, the corresponding frame CL moves vertically upwardly or downwardly from the position corresponding to the closure of the shed.

The mechanism for controlling the two knives 4 includes, at each of the opposite ends thereof, a connecting rod 5 articulated on one of the knives and on a balance beam 6 adapted to oscillate about a support pin 7. Each of the two balance beams 6 is equipped with two rollers 6*a* and 6*b* which roll on tracks 8*a* and 8*b* of a complementary cam 3 fitted on a shaft 8*c*. The shaft is driven in continuous rotation, via a transmission shown schematically at 9, by a motor of the weaving machine.

It will be readily understood that, although such a mechanism makes it possible to impart to the two knives the desired reciprocating movement, its operation at the high speeds now required of weaving machines becomes random, particularly due to the length of the kinematic chain, which includes a large number of articulating elements. Defects in weaving are, therefore, relatively frequent.

It is an object of the present invention to overcome this drawback.

SUMMARY OF THE INVENTION

The invention essentially relates to a heavy closed-shed dobby, of the type comprising two actuation knives which are reciprocating moved in opposite directions to cooperate selectively with a rocking double hook carried by pivoting levers coupled to the heddle frames of the weaving machine. The invention includes two drums rotating in synchronism, which are oriented substantially parallel to the path of the knives and the peripheries of which have two obliquely profiled grooves which are oppositely oriented therein, inside which are engaged tracking members provided axially at the end of each knife. As a result, rotation of these drums positively ensures reciprocating displacement of the knives in opposite directions.

BRIEF DESCRIPTION OF THE DRAWINGS

The invention will be more readily understood on reading the following description with reference to the accompanying drawings, in which.

As indicated hereinbefore, FIG. 1 schematically illustrates the general arrangement of a closed-shed dobby of conventional type.

DESCRIPTION OF THE PREFERRED EMBODIMENT

Figure 1:
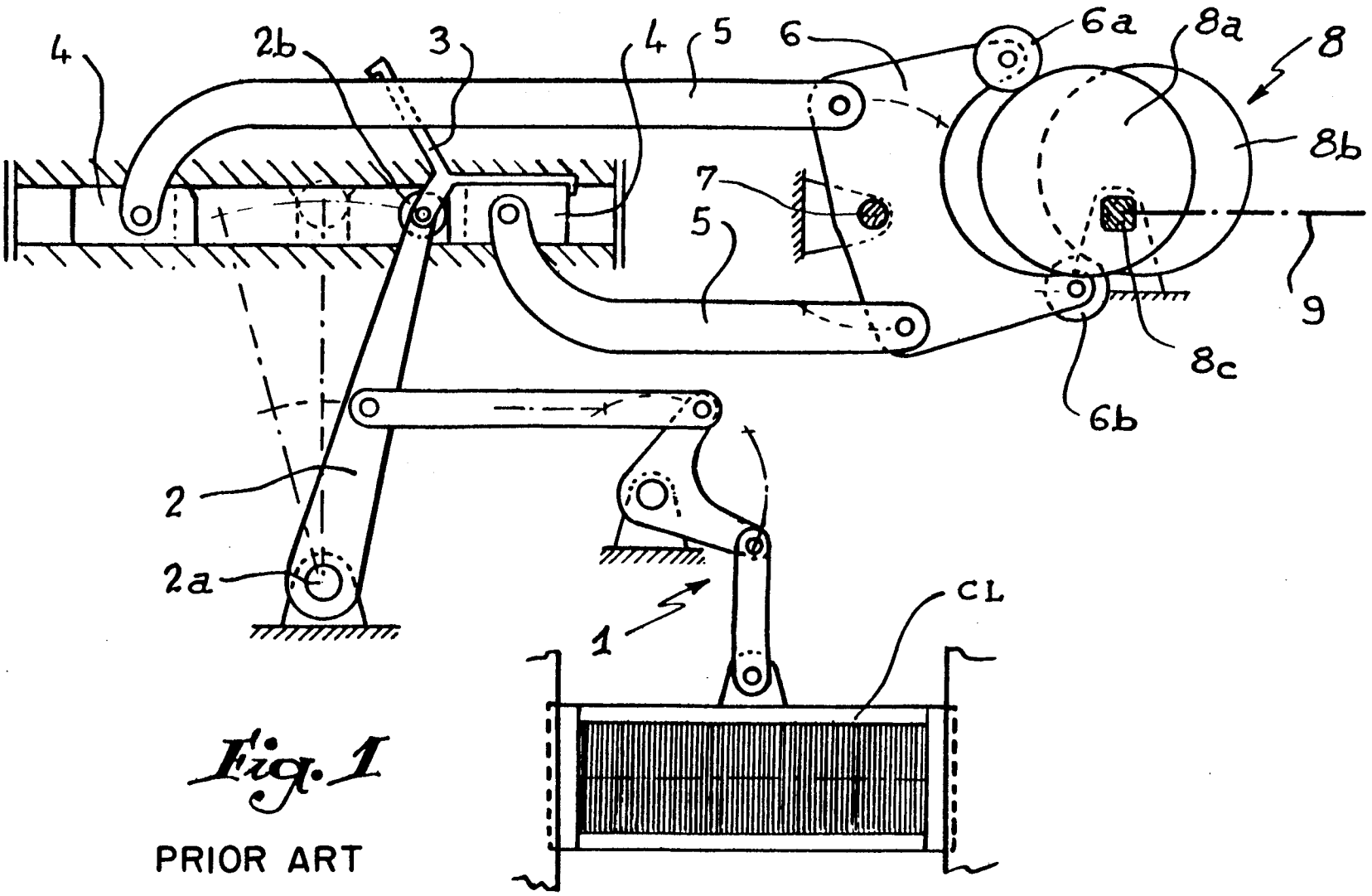
Fig. 1 PRIOR ART
Figure 2:
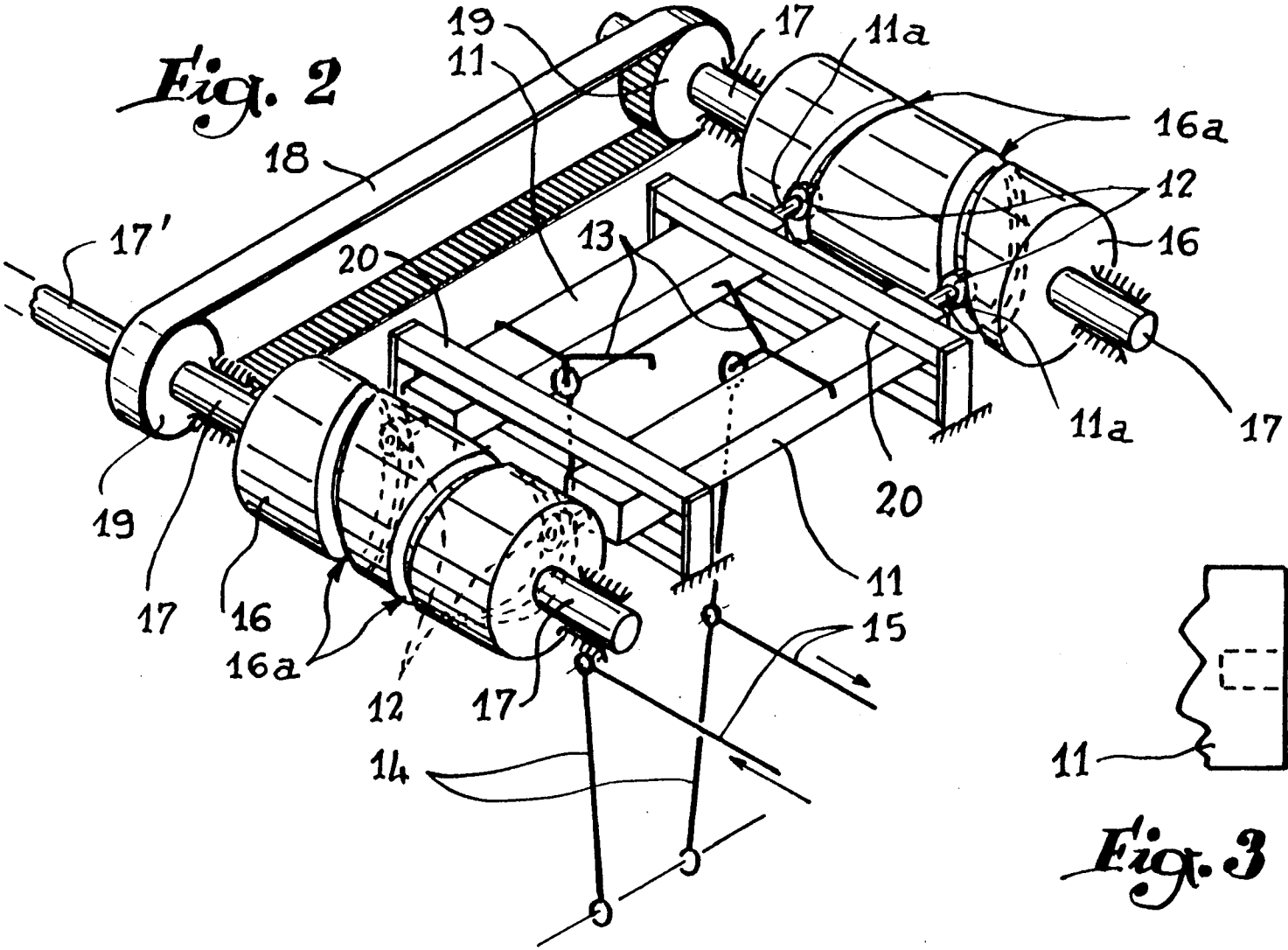
FIG. 2 is a view, in perspective, illustrating the arrangement of a dobby according to the present invention.

Referring again to the drawings, in FIG. 2, reference 11 designates the two reciprocating knives which are intended to cooperate selectively with the rocking double hook 13 mounted to pivot at the upper end of each of the oscillating levers 14 connected by a system of rods 15 to the corresponding heddle frame. It is on these hooks 13 that the pushers (not shown) of the conventional reading mechanism of the dobby act, in the manner which has been described hereinbefore.

To ensure reciprocating control of the two knives 11, the invention employs two drums 16 mounted on shafts 17 oriented transversely to the axis Of the knives, that is parallel to the direction of the movement to be imparted to the knives. The two shafts are connected to each other by belt 18 associated with two corresponding pulleys 19, one of these shafts extends axially at 17' to be drivingly connected to a drive shaft (not shown) of the weaving machine controlled by the dobby shown, or to that of an independent motor.

Figure 3:
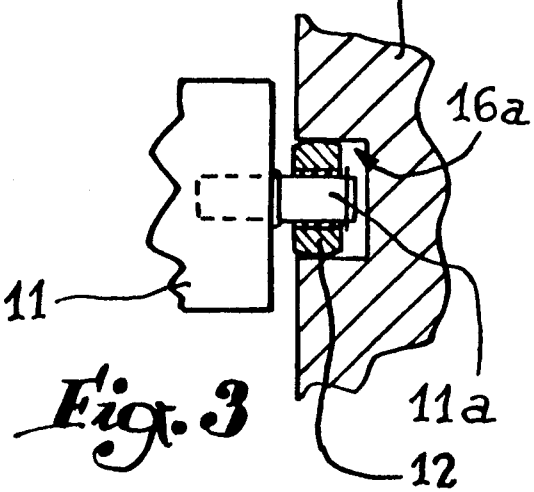
FIG. 3 is a section, in detail, illustrating the cooperation of the drums and the ends of the knives.

Each drum 16 has two grooves 16*a* formed therein, inside each of which is engaged a tracking member including a roller 12 (FIG. 3) mounted idly on pins 11*a*, provided axially at each of the ends of the knives 11. It will be readily appreciated that, by an appropriate profiling of the grooves 16*a* and a suitable offset of the grooves, the rotation of the drums 16 will impart the desired reciprocating movement to knives 11 which extend between horizontal guides shown at 20. As shown, the grooves are obliquely profiled and extend in opposite directions to one another.

The reversal of the movement of each knife is thus effected progressively, without sudden jerks. Furthermore and especially, the knives 11 are directly connected so as to follow the profile of the grooves 16*a* of the drums 16, without any intermediate articulating members. The movement of the knives is thus of perfect quality, absolutely invariable during operation. The dobby according to the invention may thus operate at very high working speeds, without parasitic vibrations and without risk of weaving defects. In addition, it will be observed that the present structure is more compact and more economical than the conventional structures.

It goes without saying that the belt-and-pulley transmission 18–19 may be replaced by any other equivalent systems (chain, gears, etc . . . ) which are adapted to ensure a synchronous drive of the two drums 16.

What is claimed is:

1. In a knife control mechanism for a heavy closed-shed dobby for a weaving machine which includes two actuation knives which are movable in opposite reciprocating motions along a path in order to selectively engage a rocking double hook carried by pivoting levers coupled to a heddle frame, the improvement comprising, each of said knives having opposite ends, tracking means extending from each of said opposite ends, a pair of drums spaced adjacent said opposite ends of said knives and having central axes generally parallel to the path of motion of said knives, means for rotating said drums in synchronism with one another, each of said drums including a peripheral portion having two spaced profiled grooves therein, and said tracking means being guidingly received within said grooves whereby, when said drums are rotated, said knives will be reciprocately driven along the path of motion.

2. The knife control mechanism of claim 1 in which each of said grooves is obliquely oriented in opposite directions relative to the axis of the respective drum.

3. The knife control mechanism of claim 2 in which each of said tracking members includes a pin extending from each of said opposite ends of said knives, and a roller mounted to each of said pins, said rollers being engagable within said grooves.

4. The knife control mechanism of claim 3 in which said drums are mounted on spaced rotatable shafts, and said means for rotating said drums in synchronism includes a continuous drive element drivingly engagable with said shafts.

5. The knife control mechanism of claim 3 in which said knives extend between pairs of spaced guide members.

6. The knife control mechanism of claim 1 in which each of said tracking members includes a pin extending from each of said opposite ends of said knives, and a roller mounted to each of said pins, said rollers being engagable within said grooves.

7. The knife control mechanism of claim 1 in which said drums are mounted on spaced rotatable shafts, and said means for rotating said drums in synchronism includes a continuous drive element drivingly engagable with said shafts.

8. The knife control mechanism of claim 1 in which said knives extend between pairs of spaced guide members.

* * * * *